US009085067B2

(12) United States Patent
Stayton

(10) Patent No.: US 9,085,067 B2
(45) Date of Patent: Jul. 21, 2015

(54) SPANNER WRENCH STRUCTURE AND METHOD

(76) Inventor: Stephen Burton Stayton, Tucson, AZ (US)

( * ) Notice: Subject to any disclaimer, the term of this patent is extended or adjusted under 35 U.S.C. 154(b) by 0 days.

(21) Appl. No.: 13/480,082

(22) Filed: May 24, 2012

(65) Prior Publication Data

US 2012/0297604 A1 Nov. 29, 2012

Related U.S. Application Data

(60) Provisional application No. 61/491,160, filed on May 27, 2011.

(51) Int. Cl.

| | |
|---|---|
| ***B25B 5/06*** | (2006.01) |
| ***B25B 13/50*** | (2006.01) |
| ***B25B 13/48*** | (2006.01) |

(52) U.S. Cl.

CPC ..... *B25B 13/48* (2013.01); *B25B 13/5008* (2013.01)

(58) Field of Classification Search

USPC ..... 269/6, 3, 95, 143, 249; 29/244–270

See application file for complete search history.

(56) References Cited

U.S. PATENT DOCUMENTS

| | | | |
|---|---|---|---|
| 2,389,954 | A | 11/1945 | Burns |
| 2,414,281 | A | 1/1947 | Trimmer |
| 2,542,728 | A | 2/1951 | Thoms |
| 4,584,914 | A | 4/1986 | Hall et al. |
| 5,347,891 | A | 9/1994 | Kamp et al. |

OTHER PUBLICATIONS skgrimes.com/products/spanner-wrench, Admitted Prior art Aug. 25, 2013.

bhphotovideo.com/c/product/71000-REG/General_Brand_NPLSS_Lens_Spanner_Wrench.html, Admitted Prior art Aug. 25, 2013.

thorlabs.us/thorproduct.cfm?partnumber=SPW302, Admitted Prior Art Aug. 25, 2013.

thorlabs.us/thorproduct.cfm?partnumber=SPW801, Admitted Prior Art Aug. 25, 2013.

edmundoptics.com/lab-production/general-tools/spanner-wrench-set/1457, Admitted Prior Art Aug. 25, 2013.

edmundoptics.com/lab-production/general-tools/mini-spanner-wrench-set/2000, Admitted Prior Art Aug. 25, 2013.

*Primary Examiner* — Lee D Wilson

(57) ABSTRACT

A spanner wrench and a method of rotating an object with the spanner wrench is provided. The spanner wrench is configured to engage and rotate the object, and the spanner wrench is supported in a manner that resists tilting and transverse movement of the spanner wrench as the spanner wrench is rotating the object.

14 Claims, 9 Drawing Sheets

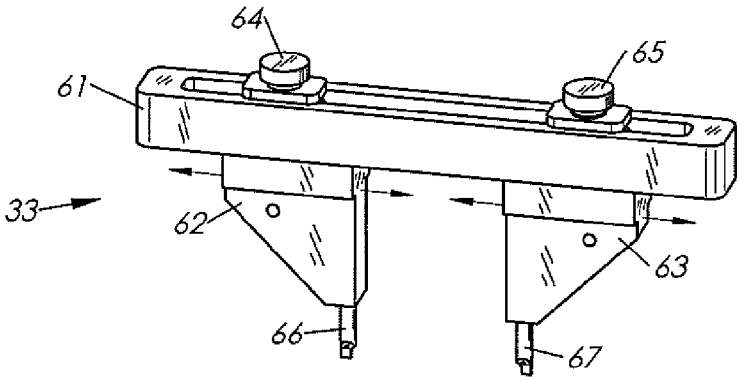
FIG. 10
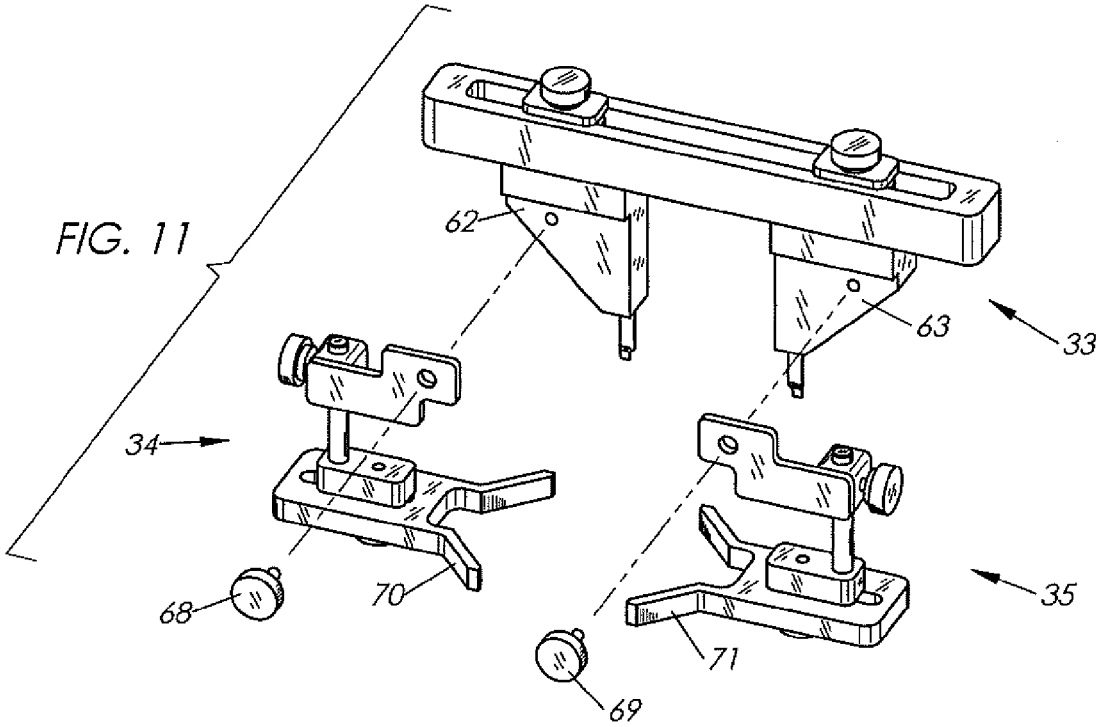

SPANNER WRENCH STRUCTURE AND METHOD

RELATED APPLICATION/CLAIM OF PRIORITY

This application is related to and claims priority from U.S. provisional application Ser. No. 61/491,160, filed May 27, 2011, and entitled Spanner Wrench Structure and Method, which provisional application is incorporated by reference herein

BACKGROUND

Introduction

The present invention relates to a spanner wrench structure, and to a method of operating the spanner wrench. The spanner wrench structure and method of the present invention is designed to balance forces during its operation in a way that resists the wrench tilting or shifting as it is being operated. The spanner wrench structure and method is particularly useful for tightening (or loosening) a retainer ring in a barrel that supports one or more optics or other components Some known types of spanner wrench, and their methods of operation, are shown and described in FIGS. 1-9. FIGS. 1 and 2 show a dual beam adjustable spanner wrench. The wrench 30 (FIG. 1) comprises dual fixed beams 41 and 42 extending through, and transverse to a pair of longitudinal adjustable heads 43 and 44 with rectangular profile tips 45 and 46. The spanner wrench 31 (FIG. 2) has identical construction except for circular profile tips 51 and 52 at the distal ends of adjustable heads 49 and 50. Locking thumbscrews 47 and 48 (FIG. 1) act between the beams and the heads to enable adjustment of the fixed beams relative to the heads, thereby enabling adjustment of the spacing between the rectangular or circular profile tips. In the single beam adjustable spanner wrench version shown in FIG. 3, the heads 54 and 55 are slideable on fixed beam 53 and configured to receive and support different profile tips 56 and 57, so the version of FIG. 3 provides for interchangeable spanner tips.

FIG. 4 is an exploded view illustrating the spanner wrench 30 of FIG. 1, and the optical component assembly 32 with which the spanner wrench operates. Those components comprise an internally threaded barrel 58, that supports an optical component 59 (e.g. a lens) or other type of component that fits in the barrel. The component 59 would rest on a shoulder on the inside of the barrel 58, and an externally threaded retaining ring 60 is inserted in the barrel and tightened to hold the component in the barrel. As illustrated in FIGS. 5 and 6, the retaining ring has a pair of slots that are engaged by the tips of the heads, to engage the spanner wrench with the retaining ring. Turning of the spanner wrench 30 about the axis of the barrel results in application of torque to the retaining ring to tighten the retaining ring against the component, to hold the component in place in the barrel. In a similar manner the spanner wrench 30 is used to loosen and to remove the retaining ring from an assembled set of components with an opposite direction of rotation of the wrench about the axis of the barrel.

FIGS. 7-9 are similar to FIGS. 4-6, but show the structure and operation of the spanner wrench 31 of FIG. 2 with a circular profile tips rather than rectangular profile tips.

The types of spanner wrench shown in FIGS. 1-9 would require care in the manual manipulation of the wrench, to avoid applying forces in undesirable ways. For example, if forces are applied in a manner that could cause tilting of the wrench or lateral (sideways) shifting of the wrench, the torque applied could be skewed, and the precision with which the component is located in the barrel could be affected or the wrench tips could be dislodged from the mating slot or hole feature in the retaining ring creating a situation where damage to the wrench or barrel components could occur Thus, in applicant's experience, it is desirable to design a spanner wrench so that the likelihood of the wrench causing a tiling moment or shifting laterally relative to the barrel is minimized.

SUMMARY OF THE PRESENT INVENTION

The present invention (described below, and shown and described in the accompanying drawings) provides a spanner wrench and method designed to achieve the applicant's design objective. The spanner wrench is designed to rotate an object such as a retaining ring, in a manner that minimizes the likelihood of the wrench causing a tiling moment or shifting laterally as the wrench is used to rotate the object.

The present invention relates to a new and useful spanner wrench, and to a new and useful method of rotating a cylindrical object (e.g. using the spanner wrench).

A spanner wrench according to the present invention, comprises a pair of adjustable heads with tips configured to engage slots or holes in a cylindrical object in a manner enabling the spanner wrench to rotate the object relative to a mating cylindrical part, and a pair of guide mechanisms configured to resist tilting of the spanner wrench relative to the axis of the mating cylindrical part and displacement of the spanner wrench relative to the axis of the mating cylindrical part as the spanner wrench is engaged with and is rotating the cylindrical object relative to the mating cylindrical part.

In one of its preferred configurations, the spanner wrench includes a pair of guide mechanisms, each of which comprises a pair of guide bushings oriented to engage opposite sides of the mating cylindrical part, and wherein the step of supporting the spanner wrench comprises selectively adjusting the pairs of guide bushings axially and radially relative to the axis of the mating cylindrical part, so that the pairs of guide bushings are placed in contact with opposite sides of the mating cylindrical part in a manner that resists tilting of the spanner wrench relative to the axis of the mating cylindrical part and displacement of the spanner wrench relative to the axis of the mating cylindrical part as the spanner wrench is engaged with and is rotating the cylindrical object relative to the mating cylindrical part.

In another of its preferred configurations, the spanner wrench includes a pair of guide mechanisms each of which comprises a pair of vee-shaped guides each having a plurality of surfaces configured to face surface portions of the mating cylindrical part, and wherein the step of supporting the spanner wrench comprises selectively adjusting the pairs of vee-shaped guides axially and radially relative to the axis of the mating cylindrical part, so that the pair of vee-shaped guides are placed in adjacent relationship to the surface portions of the mating cylindrical part in a manner that resists tilting of the spanner wrench relative to the axis of the mating cylindrical part and displacement of the spanner wrench relative to the axis of the mating cylindrical part as the spanner wrench is engaged with and is rotating the cylindrical object relative to the mating cylindrical part.

In all of the foregoing configurations, the spanner wrench is particularly useful where the mating cylindrical object comprises a barrel that supports one or more optics.

In a method of rotating a cylindrical object relative to a mating cylindrical part, according to the present invention, a spanner wrench is configured to engage and rotate the cylindrical object relative to the mating cylindrical part, and the spanner wrench is supported in a manner that resists tilting of the spanner wrench relative to the axis of the mating cylindrical part and displacement of the spanner wrench relative to the axis of the mating cylindrical part as the spanner wrench is engaged with and is rotating the cylindrical object relative to the mating cylindrical part.

The spanner wrench and method of the present invention are particularly useful where the mating cylindrical object comprises a barrel that supports one or more optics, because the spanner wrench guide mechanisms and adjustment mechanism prevents slippage of the wrench during operation that could result in damage to an optical surface if any component of the wrench comes in contact with an optical surface.

These and other features of the present invention will become further apparent from the following detailed description and the accompanying drawings.

BRIEF DESCRIPTION OF THE DRAWINGS

FIGS. 10-14 show a version of a spanner wrench structure and method, designed according to the principles of the present invention;

DETAILED DESCRIPTION

As described above, the present invention provides a new and useful spanner wrench and method that are particularly useful with a mating cylindrical object that comprises a barrel that supports one or more optics, because the spanner wrench guides and adjustment mechanism prevents slippage of the wrench during operation that could result in damage to an optical surface if any component of the wrench comes in contact with an optical surface. The principles of the present invention are described below in connection with rotation of a cylindrical object that is a ring for a cylindrical barrel that supports one or more optics, and from that description, the manner in which the principles of the invention can be used for turning different cylindrical objects in different cylindrical parts will be apparent to those in the art.

FIGS. 10-14 show a version of a spanner wrench structure and method, designed according to the principles of the present invention.

Figure 12:
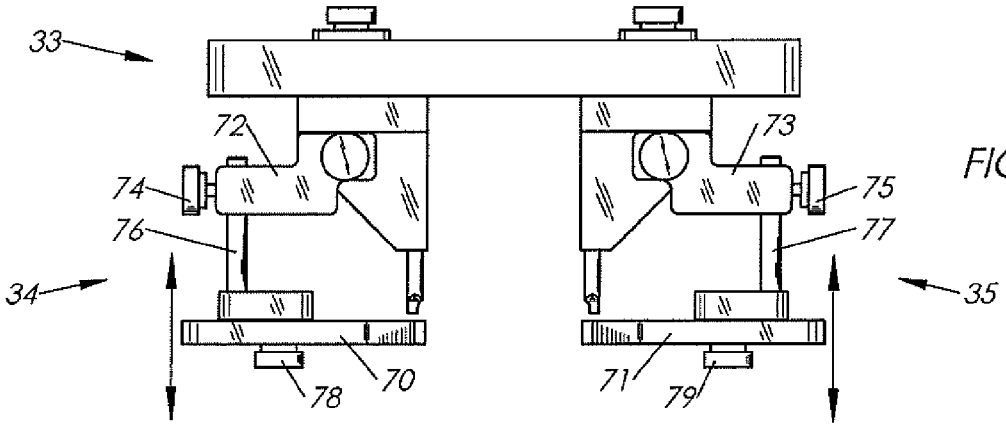
Figure 13:
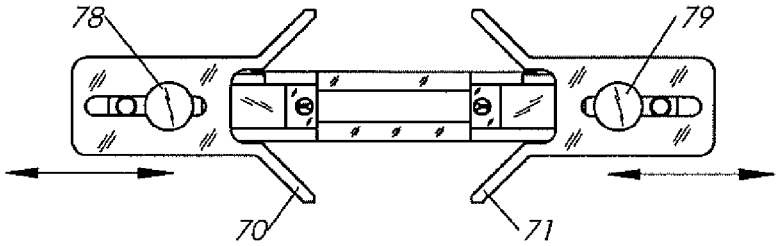

As shown in FIG. 10, a spanner wrench 33 comprises a pair of adjustable heads 62 and 63 with interchangeable spanner tips 66 and 67. The adjustable heads are triangular shaped bodies that are connected to a support beam 61, and whose lateral positions on the support beam can be selectively adjusted and subsequently fixed in position by a pair of thumb screw actuated clamps 64 and 65. As shown in exploded view FIG. 11, a pair of guide mechanisms 34 and 35 are configured to attach to the side of heads 62 and 63 and be constrained in location relative to the heads by thumb screws 68 and 69. The guide mechanisms 34 and 35 are mirror images of each other. As shown in FIGS. 12 and 13 the guide mechanisms are comprised of attachment brackets 72 and 73 that support a vertical (axial) adjustment mechanism and support a horizontal (radial) adjustment mechanism whose function is to locate and support the pair of vee guides 70 and 71. Each of the vee guides comprises a pair of functional surfaces parallel to the vertical axis arranged in a symmetric vee geometry that is shown here with a 90 degree included angle but any convenient angle will function in the same manner as the guides described in the illustrations since the angle of the vee only affects the size capacity of the guiding function. The adjustable vee guides are supported on vertical adjusting members 76 and 77 extending from the brackets. The vee guides are vertically adjustable relative to the brackets, and can be fixed in a selected vertical position by thumbscrews 74 and 75. The vee guides are horizontally adjustable and lockable relative to the vertical adjusting members by means of slotted holes and thumb screws 78 and 79. The vee guides extend symmetrically about the head supports, with the head supports located in predetermined orientation relative to the vee guides.

Figure 14:
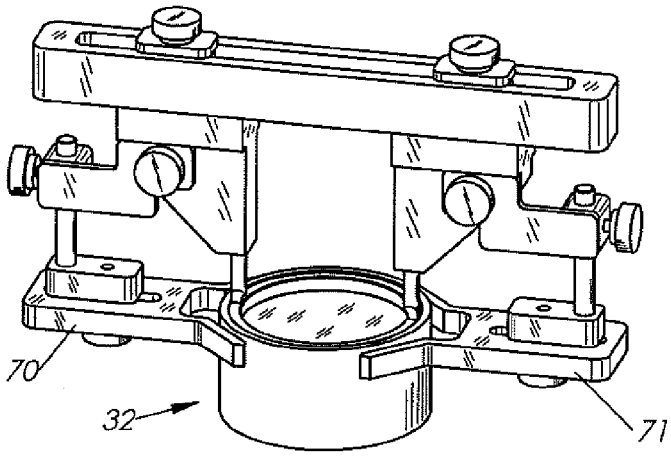

FIG. 14 shows the spanner wrench engaged with the barrel part of 32 that supports an optic or other component and retaining ring. The vee guides are adjusted axially and radially relative to the barrel axis to fit about the barrel periphery. The vee guides are adjusted to contact the barrel at 4 locations about the cylindrical barrel periphery, forming a line contact at each location, and resist both lateral movement of the spanner wrench relative to the barrel axis, and tilting of the spanner wrench relative to the barrel axis. Thus, the spanner wrench can be rotated to tighten or loosen the retainer ring, with little or no risk of tilting or lateral shifting that could affect the operation of the spanner wrench.

Figure 4:
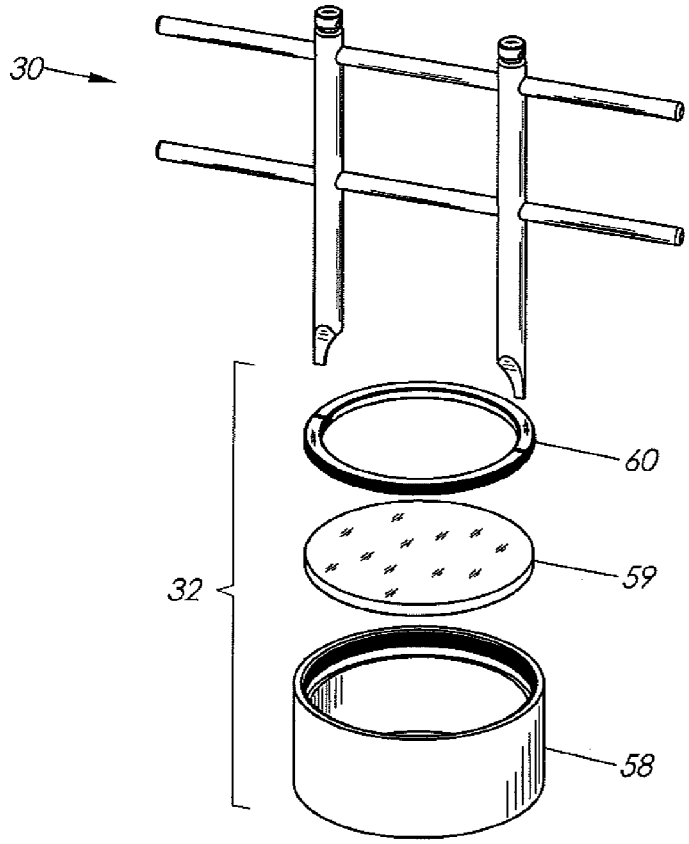
FIG. 4 (PRIOR ART)
Figure 5:
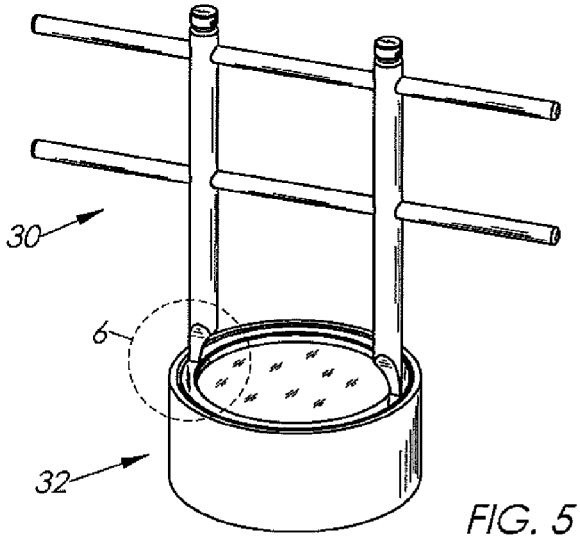
FIG. 5 (PRIOR ART)
Figure 6:
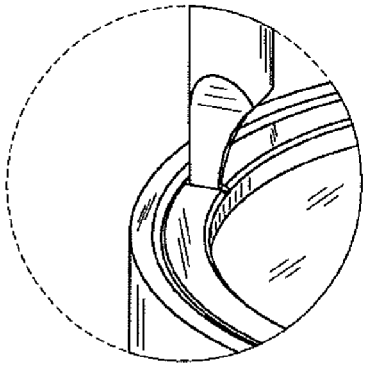
FIG. 6 (PRIOR ART)
Figure 7:
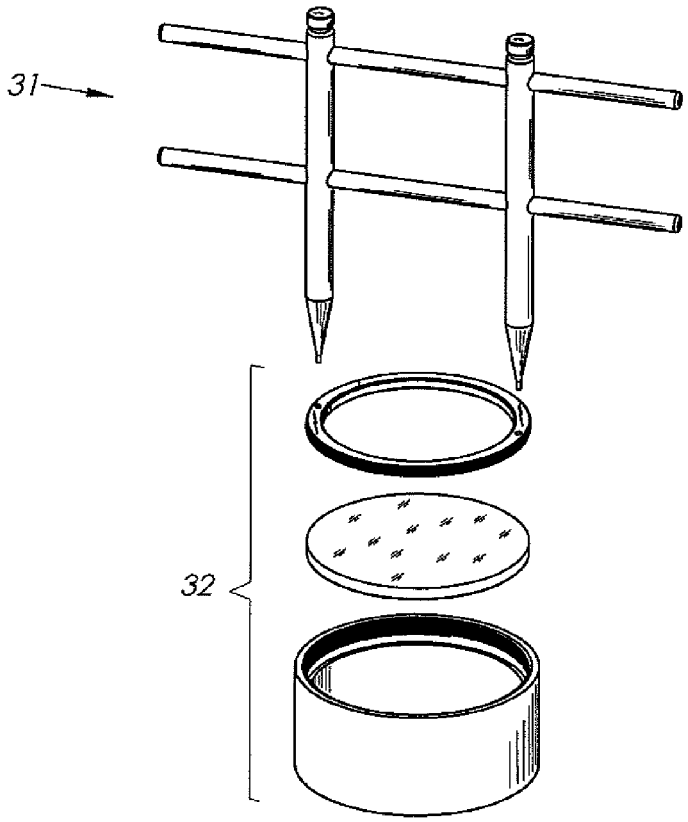
FIG. 7 (PRIOR ART)
Figure 8:
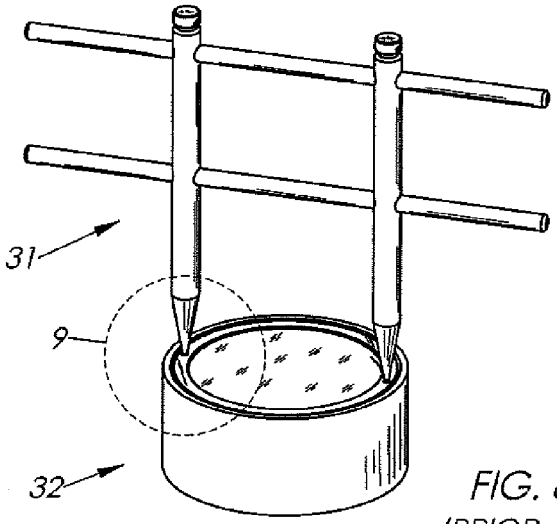
FIG. 8 (PRIOR ART)
Figure 9:
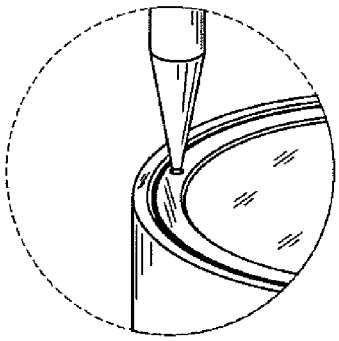
FIG. 9 (PRIOR ART)
Figure 15:
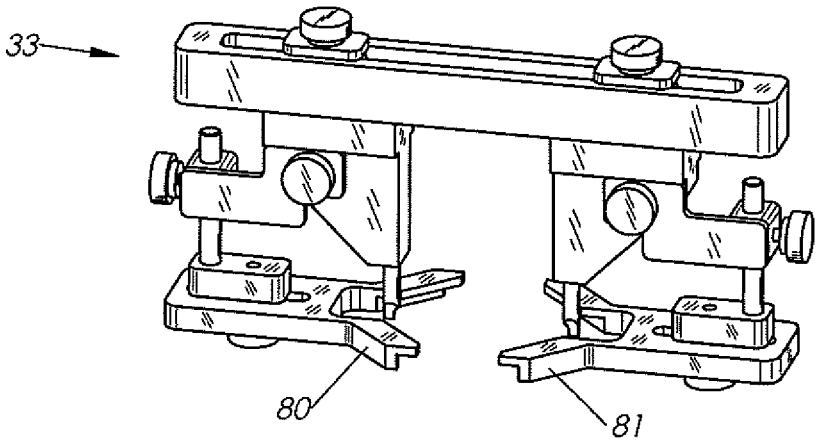
FIGS. 15-17 show another embodiment of a spanner wrench, with a different form of vee guide.
Figure 16:
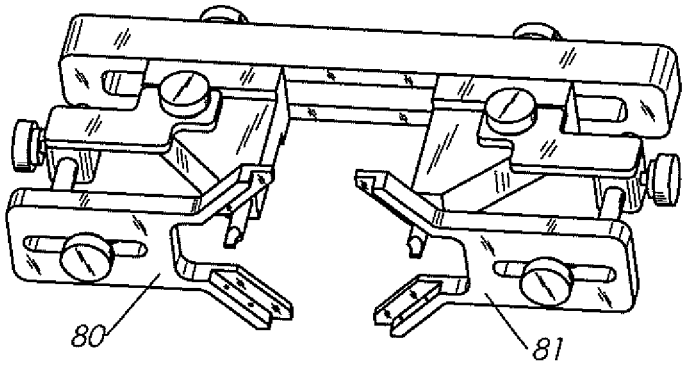
Figure 17:
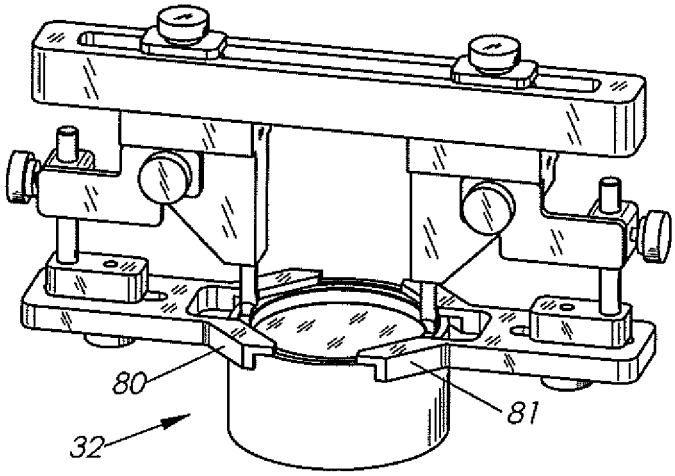
Figure 18:
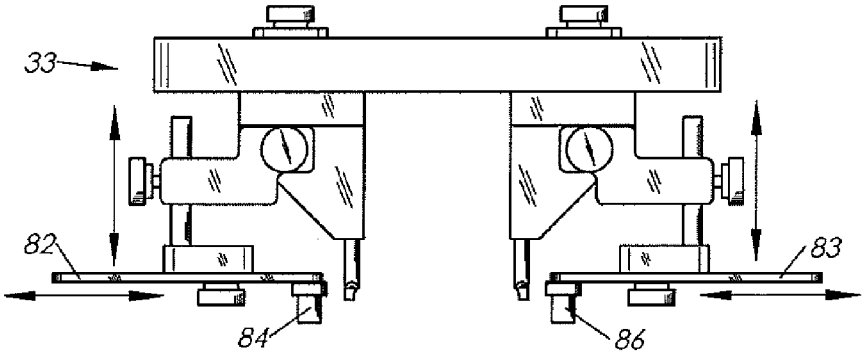
FIGS. 18-21 show still another embodiment of a spanner wrench with a different form of guiding interface.
Figure 19:
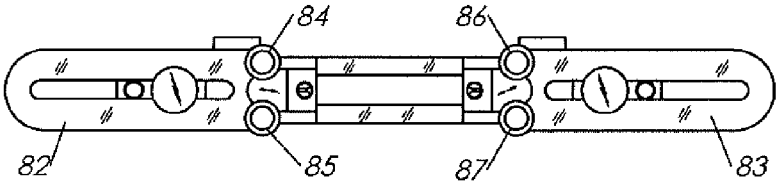
Figure 20:
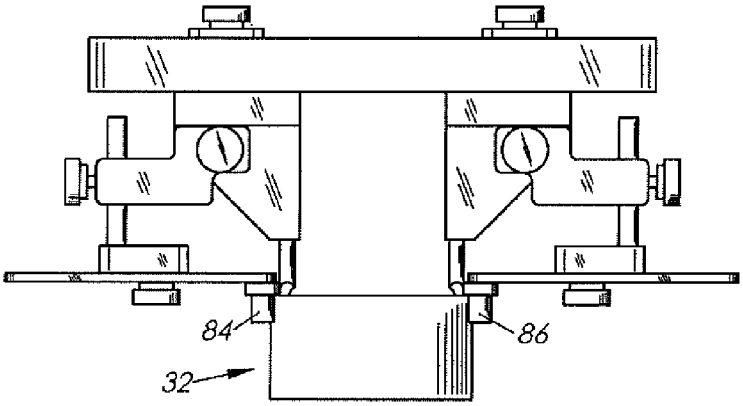
Figure 21:
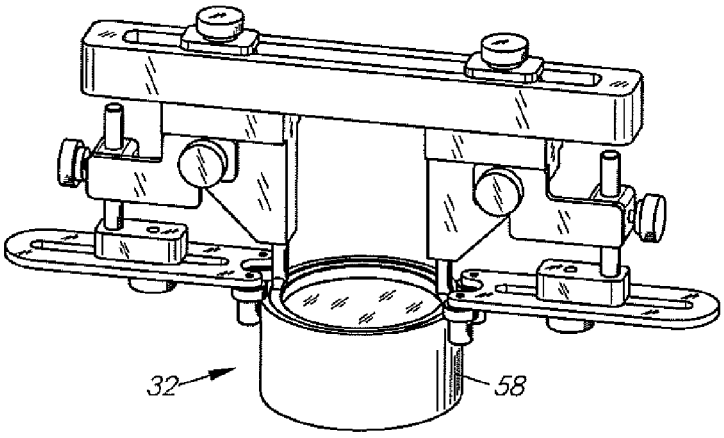

FIGS. 15-17 show another embodiment of a spanner wrench, with a different form of vee guide. This embodiment comprises the spanner wrench 33 of FIG. 10 and the adjustment mechanisms identical to those of FIGS. 11-13 to support the vee guides 80 and 81. Each of the vee guides 80 and 81 consists of 4 functional guide surfaces. In the same manner as the vee guides 70 and 71 (FIGS. 11-14) each vee guide 80 and 81 has 2 surfaces in a symmetric vee geometry where each surface is parallel to the vertical axis of the wrench 33 and the component assembly 32 axis. In addition, each vee guide 80 and 81 consists of 2 surfaces, orthogonal to the first two surfaces, located in a plane that is perpendicular to the wrench vertical axis. As shown in FIG. 17 the vee guides can be adjusted radially to engage the outer periphery of a barrel in a manner similar to the previous embodiment. Such engagement enables the spanner wrench to rotate a retainer ring in the barrel, while resisting lateral movement and tilting of the spanner wrench relative to the barrel. Each of the vee guides 80 and 81 can also be adjusted axially so that the second pair of functional guide surfaces is placed in area contact with the top flat surface of the component assembly 32 when the retaining ring 60 (FIG. 4) is fully seated against the component 59 (FIG. 4). It is in the fully seated position of the retaining ring where the spanner wrench is required to apply the maximum torque to either loosen or tighten the retaining ring. The area contact achieved by the second pair of guide surfaces provides an increased resistance to tilting of the spanner wrench relative to the component assembly at the time of maximum torque application and therefore provides an increased level of protection against accidental slippage of the wrench during operation.

FIGS. 18-21 show still another embodiment of a spanner wrench with a different form of guiding interface. This embodiment comprises the spanner wrench 33 of FIG. 10 and the adjustment mechanisms identical to those of FIGS. 11-13 to support the pair of guide plates 82, 83 and the two pairs of guide bushings 84, 85 and 86, 87. Guide plate 82 supports flanged guide bushings 84 and 85 while guide plate 83 supports flanged guide bushings 86 and 87. Each flanged guide bushing consists of smaller diameter cylindrical first member and a concentric larger diameter cylinder second member with flat flange surface orthogonal to the common cylinder axis. The guide plates are adjustable radially and axially relative to the component assembly 32, to bring the guide bushings into positions where their smaller diameter cylinder bushings engage the outer periphery of the barrel 58, and flange portions of the guide bushings engage the top face of the barrel when the retaining ring 60 (FIG. 4) is fully seated against the component 59 (FIG. 4), to resist both lateral shifting and tilting of the spanner wrench relative to the barrel as the spanner wrench is rotated to tighten or loosen the retainer ring. The flanged guide bushings 84, 85, 86 and 87 are optimally fixed relative to each respective guide plate 82 and 83. Flanged guide bushings can be made from low friction, low wear materials such as engineering thermoplastics to allow freedom of motion relative to the component barrel assembly 32. Flanged guide bushings can also be mounted to the guide plates with internal bearings to allow freedom of rotation around the axis of each guide bushing relative to a mounting stud on the respective guide plate (82, 83) to establish rolling contact between each guide bushing small diameter cylinder and the outer periphery of the barrel 58.

Figure 22:
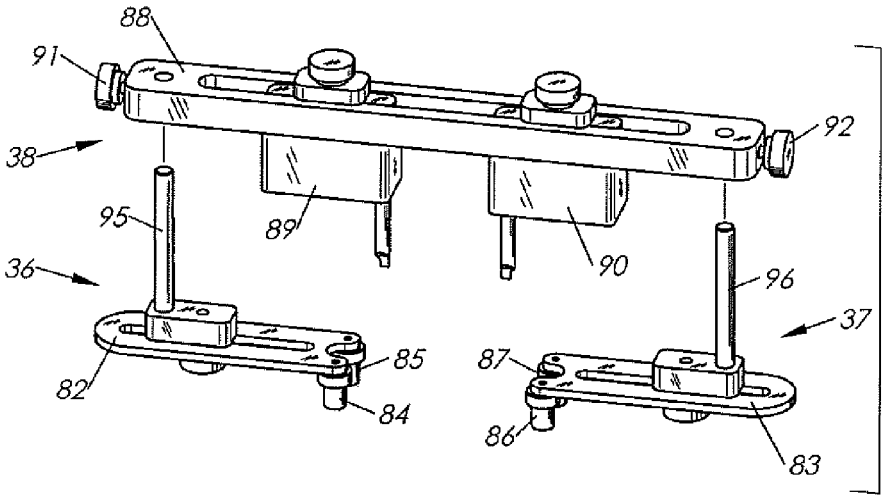
FIGS. 22 and 23 show another embodiment of a spanner wrench comprising single beam adjustable spanner and guide mechanisms.
Figure 23:
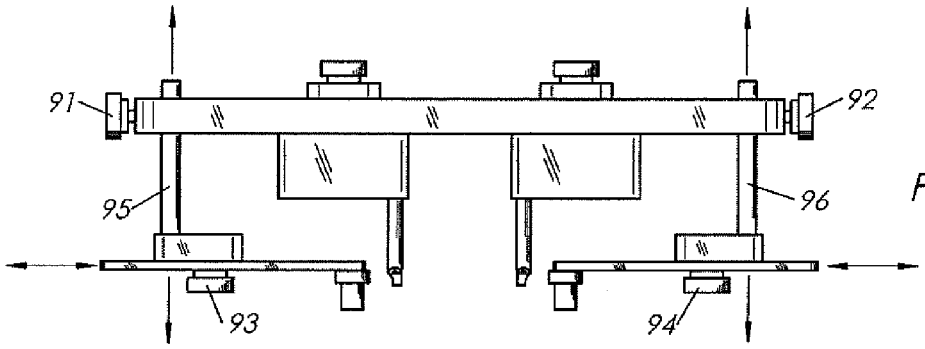
Figure 24:
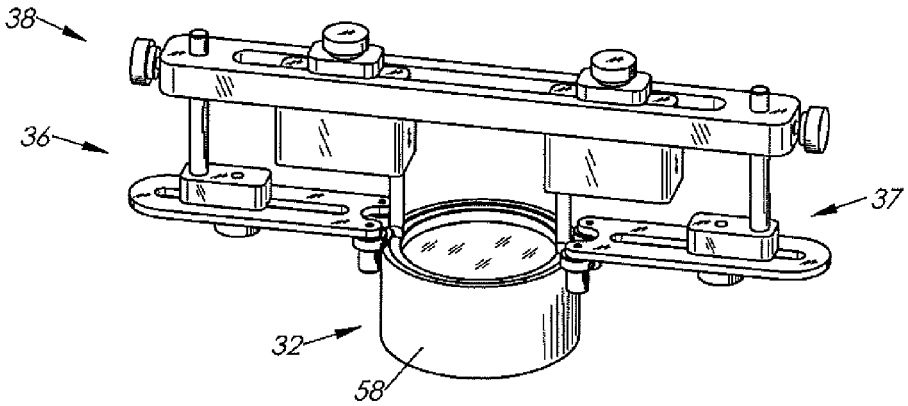
FIG. 24 shows the spanner wrench of FIGS. 22 and 23 on the component assembly where the flanged guide bushings are adjusted to contact the component barrel in the same manner as the guides in the embodiment of FIGS. 20 and 21.

FIGS. 22 and 23 show another embodiment of a spanner wrench comprising single beam adjustable spanner 38 and guide mechanisms 36 and 37. The spanner 38 comprises the single fixed beam 88 and adjustable heads 89 and 90 with locking thumb screw clamps in an arrangement functionally similar to spanner 33 in FIG. 10. The pair of guide mechanisms 36 and 37 are comprised of vertical guide rods 95 and 96 that support horizontally adjustable guide plates 82 and 83 with flanged guide bushing pairs 84,85 and 86,87. In this embodiment the guide mechanisms 36 and 37 are connected directly to the spanner beam 88 by means of vertical guide rods 95 and 96. The guide mechanisms are clamped in the desired vertical position with thumb screws 91 and 92. Guide plates 82 and 83 are clamped in the desired horizontal position with thumb screws 93 and 94. The guide plates 82 and 83 and the flanged guide bushings 84-87 are identical to those described in the previous embodiment and shown in FIGS. 18-21. FIG. 24 shows this embodiment of the spanner wrench on the component assembly 32 where the flanged guide bushings are adjusted to contact the component barrel 58 in the same manner as the guides in the previous embodiment (FIGS. 20 and 21) to prevent displacement and tilt of the spanner wrench during operation.

Figure 1:
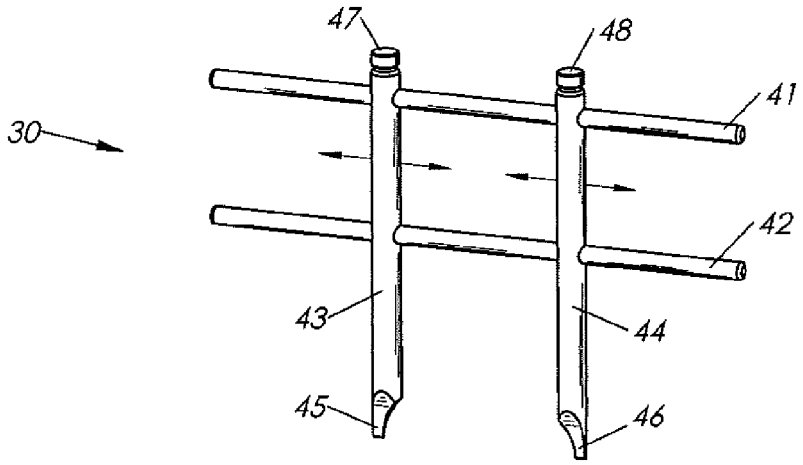
FIG. 1 (PRIOR ART)
FIGS. 1-9 illustrate some known types of spanner wrench, and their methods of operation, as described herein.
Figure 2:
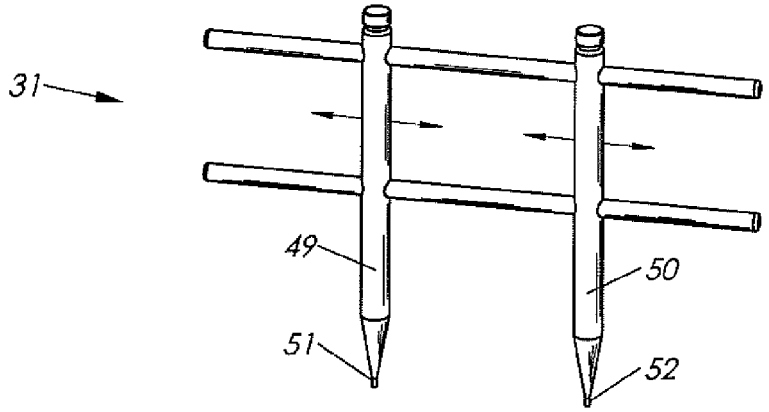
FIG. 2 (PRIOR ART)
Figure 3:
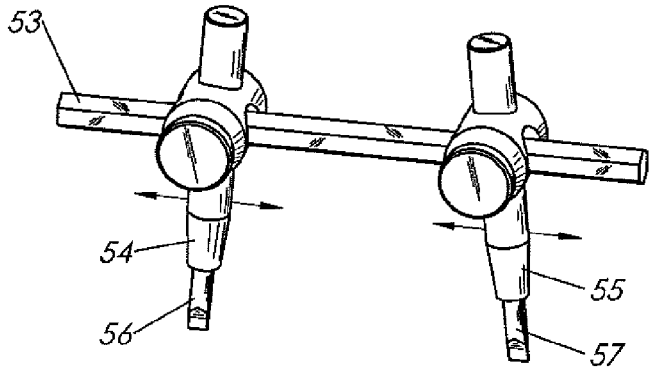
FIG. 3 (PRIOR ART)
Figure 25:
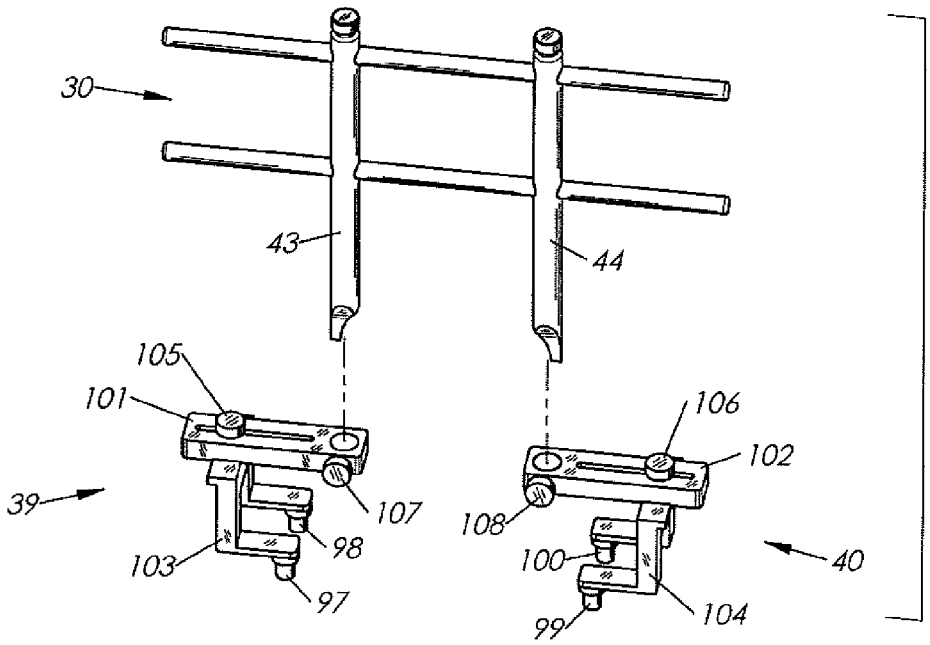
FIGS. 25 and 26 show another embodiment of the invention comprising guide mechanisms that are compatible with the conventional type of dual beam adjustable spanner wrench structure shown and described in FIG. 1
Figure 26:
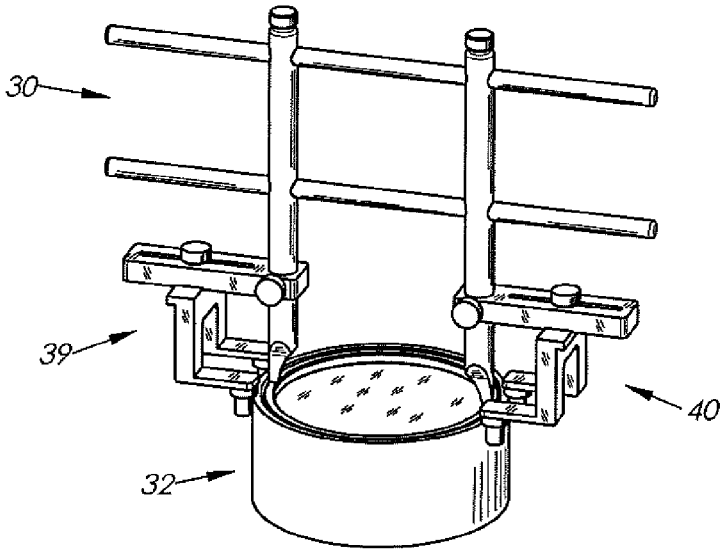

FIGS. 25 and 26 show another embodiment of the invention comprising guide mechanisms 39 and 40 that are compatible with the conventional type of dual beam adjustable spanner wrench structure 30 from FIG. 1. The guide mechanisms 39 and 40 are comprised of 2 pairs of cylindrical flanged guide bushings, 97,98 and 99,100 of the type previously described in FIGS. 18-21. Each pair of flanged guide bushings is mounted on respective horizontally adjustable brackets 103 and 104. The brackets 103 and 104 are adjustable horizontally on brackets 101 and 102 and lockable with thumbscrews 105 and 106 to allow for the desired radial positioning of the guide bushings relative to the component assembly 32. The brackets 101 and 102 attach to the adjustable spanner heads 43 and 44 directly in a manner that allows for the required vertical (axial) positioning of the guide mechanism. The brackets 101 and 102 are locked in the desired vertical position on heads 43 and 44 with thumb screws 107 and 108. FIG. 26 shows this embodiment of the invention located on and adjusted for operation on component barrel assembly 32 so that tilt and displacement of the spanner wrench is prevented during installation or removal of the barrel assembly retaining ring.

Thus, as seen from the foregoing description, applicant has provided a spanner wrench designed to rotate an object such as a retaining ring, in a manner that minimizes the likelihood of the wrench causing a tiling moment or shifting laterally as the wrench is used to rotate the object. With the foregoing disclosure in mind, various other ways in which a spanner wrench can be designed and operated to provide such objectives will be apparent to those in the art. Moreover, it will be apparent that applicant has provided a new and useful method of rotating a cylindrical object relative to a mating cylindrical part, according to the present invention, by providing a spanner wrench configured to engage and rotate the cylindrical object relative to the mating cylindrical part, and supporting the spanner wrench in a manner that resists tilting of the spanner wrench relative to the axis of the mating cylindrical part and displacement of the spanner wrench relative to the axis of the mating cylindrical part as the spanner wrench is engaged with and is rotating the cylindrical object relative to the mating cylindrical part.

The invention claimed is:

1. A spanner wrench comprising a pair of adjustable heads with tips configured to engage slots or holes in a cylindrical object in a manner enabling the spanner wrench to rotate the object relative to a mating cylindrical part having an outer periphery, and a pair of guide mechanisms engaging the outer periphery of the mating cylindrical part and configured to resist tilting of the spanner wrench relative to the axis of the mating cylindrical part and displacement of the spanner wrench relative to the axis of the mating cylindrical part as the spanner wrench is engaged with and is rotating the cylindrical object relative to the mating cylindrical part.

2. The spanner wrench of claim 1, wherein the pair of guide mechanisms each comprises a pair of guide bushings oriented to engage opposite sides of the outer periphery of the mating cylindrical part, and wherein the pair of guide mechanisms are configured to selectively adjust each pair of guide bushings axially and radially relative to the axis of the mating cylindrical part, so that the pairs of guide bushings can be selectively placed in contact with opposite sides of the outer periphery of the mating cylindrical part in a manner that resists tilting of the spanner wrench relative to the axis of the mating cylindrical part and displacement of the spanner wrench relative to the axis of the mating cylindrical part as the spanner wrench is engaged with and is rotating the cylindrical object relative to the mating cylindrical part.

3. The spanner wrench of claim 2, wherein each guide bushing comprises a cylindrical member with axis parallel to the axis of the mating cylindrical part such that a line contact is formed at the zone of contact between the guide hushing and the outer periphery of the mating cylindrical part.

4. The spanner wrench of claim 3, wherein each guide bushing also comprises a flanged member with a flange surface oriented perpendicular to the guide axis such that the flange surface makes area contact with the top of the mating cylindrical part.

5. The spanner wrench of claim 4, wherein the guide mechanisms comprises a pair of adjustment mechanisms, each of which is connected with a respective pair of guide bushings and each of which is connected with a respective adjustable head of the spanner wrench.

6. The spanner wrench of claim 5 wherein the mating cylindrical object comprises a barrel that supports one or more optics.

7. The spanner wrench of claim 4, wherein the spanner wrench one or more beams that extend transverse to the adjustable heads, and wherein the pair of guide mechanisms each comprises an adjustable bracket, each bracket being connected with a respective pair of guide bushings and each bracket being connected with a respective portion of a beam of the spanner wrench.

8. The spanner wrench of claim 7, wherein the mating cylindrical object comprises a barrel that supports one or more optics.

9. A spanner wrench comprising a pair of adjustable heads with tips configured to engage slots or holes in a cylindrical object in a manner enabling the spanner wrench to rotate the object relative to the mating cylindrical part, and a pair of guide mechanisms engaging the mating cylindrical part and configured to resist tilting of the spanner wrench relative to the axis of the mating cylindrical part, and displacement of the spanner wrench relative to the axis of the mating cylindrical part as the spanner wrench is engaged with and is rotating the cylindrical object relative to the mating cylindrical part, wherein the pair of guide mechanisms each comprises a vee-shaped guide, each guide having two surfaces configured to face surface portions of the mating cylindrical part, and wherein the guide mechanism is configured to selectively adjust the pair of vee-shaped guides axially and radially relative to the axis of the mating cylindrical part, so that the pair of vee-shaped guides can be selectively placed in adjacent relationship to the surface portions of the mating cylindrical part in a manner that resists tilting of the spanner wrench relative to the axis of the mating cylindrical part and displacement of the spanner wrench relative to the axis of the mating cylindrical part as the spanner wrench is engaged with and is rotating the cylindrical object relative to the mating cylindrical part.

10. The spanner wrench of claim 9, wherein each vee-shaped guide also comprises a flanged member with a flange surface oriented perpendicular to the axis of the mating cylindrical part such that the flange surface makes area contact with he top of the mating cylindrical part.

11. The spanner wrench of claim 10, wherein the pair of guide mechanisms each comprises an adjustable bracket, each bracket being connected with a respective vee-shaped guide and each bracket being connected with a respective adjustable head of the spanner wrench.

12. The spanner wrench of claim 11, wherein the mating cylindrical object comprises a barrel that supports one or more optics.

13. The spanner wrench of claim 10, wherein the spanner wrench one or more beams that extend transverse to the adjustable heads, and wherein the pair of guide mechanisms each comprises an adjustable bracket, each of which is connected with a respective vee-shaped guide and each of which is connected with a respective portion of a beam of the spanner wrench.

14. The spanner wrench of claim 13, wherein the mating cylindrical object comprises a barrel that supports one or more optics.

* * * * *